US006518943B1

(12) United States Patent
Masumura

(10) Patent No.: US 6,518,943 B1
(45) Date of Patent: Feb. 11, 2003

(54) DRIVING APPARATUS FOR DRIVING A PLASMA DISPLAY PANEL

(75) Inventor: Yuuki Masumura, Fukuroi (JP)

(73) Assignee: Pioneer Corporation, Tokyo (JP)

( * ) Notice: Subject to any disclaimer, the term of this patent is extended or adjusted under 35 U.S.C. 154(b) by 165 days.

(21) Appl. No.: 09/583,757

(22) Filed: May 31, 2000

(30) Foreign Application Priority Data

Jun. 1, 1999 (JP) ..... 11-153497

(51) Int. Cl.[7] ..... G09G 3/28
(52) U.S. Cl. ..... 345/67; 345/60
(58) Field of Search ..... 345/55–72, 204–215, 345/690–699, 112; 315/169.1–169.4

(56) References Cited

U.S. PATENT DOCUMENTS 3,883,778 A * 5/1975 Kaji et al. ..... 315/205
4,385,293 A * 5/1983 Wisnieff ..... 345/63
5,463,278 A * 10/1995 Gray ..... 315/169.1
6,075,513 A * 6/2000 Reddy et al. ..... 345/112
6,100,863 A * 8/2000 Zhu ..... 345/89
6,222,512 B1 * 4/2001 Tajima et al. ..... 345/63

FOREIGN PATENT DOCUMENTS

JP 07-248744 * 9/1995 ..... G09G/3/28

* cited by examiner

*Primary Examiner*—Steven Saras
*Assistant Examiner*—Michael J Moyer
(74) *Attorney, Agent, or Firm*—Morgan, Lewis & Bockius LLP

(57) ABSTRACT

A driving apparatus for driving a plasma display panel, which can reduce radiation noises, varies each application timing of a drive pulse that is applied repeatedly to row electrodes and column electrodes of the plasma display panel.

3 Claims, 6 Drawing Sheets

DRIVING APPARATUS FOR DRIVING A PLASMA DISPLAY PANEL

BACKGROUND OF THE INVENTION

1. Field of the Invention

The present invention relates to a driving apparatus for driving a plasma display panel employing a matrix display scheme.

2. Description of Related Art

In recent years, display units with a screen increased in size have longed for thin display devices. AC (Alternating current discharge) plasma display panels have received attention as one of the thin shape self-light-emitting display devices.

A discharge cell corresponding to one pixel in a plasma display panel is adapted to use a discharge phenomenon to perform light-emission display and thus have only two states, "light-emitting" and "non-light-emitting". In order to implement the display of gray scale brightness in accordance with a video signal, the plasma display panel is driven by a sub-field method.

In the sub-field method, one field period is divided into N sub-fields. A number of times of light emission corresponding to a weight of each bit digit of pixel data (N-bit data obtained by sampling a video signal corresponding to each pixel) is assigned to each sub-field. Here, first, in accordance with the aforementioned pixel data, sub-fields allowed to emit light and those not allowed to emit light are determined. Then, of these N sub-fields, only in the sub-fields allowed to emit light, discharge is generated for the number of times of light emission assigned to the sub-fields.

For example, as shown in FIG. 1, in a case where one field period is divided into four sub-fields SF1–SF4, a number of times of light emission are assigned to each of the sub-fields SF1–SF4 as follows. That is,

SF1: 1

SF2: 2

SF3: 4

SF4: 8.

Here, one visually identifies display brightness "3" when discharge is generated only in the sub-fields SF1 and SF2, and display brightness "7" when discharge is generated in the sub-fields SF1–SF3.

FIG. 2 is a view showing the configuration of a plasma display device, driven by such sub-field method, for displaying images.

As shown in FIG. 2, such plasma display device comprises a plasma display panel 10 (hereinafter referred to as "PDP 10") and a drive portion for driving the PDP 10 in accordance with an input video signal.

The PDP 10 comprises address electrodes or m column electrodes $D_1$–$D_m$, and n row electrodes $X_1$–$X_n$ and n row electrodes $Y_1$–$Y_n$, the row electrodes being arranged in transverse relation with each of the column electrodes. Here, a pair of a row electrode X and a row electrode Y forms a row electrode that corresponds to one row of the PDP 10. The column electrodes D and the row electrodes X and Y are dielectrically insulated in discharge spaces, and a discharge cell is formed corresponding to one pixel at a crossover of each of the pairs of row electrodes and a column electrode.

However, in the configuration shown in FIG. 2, there is a problem that the spectrum of radiation noises that are generated by a variety of pulses for driving the display panel 10 concentrate on the natural frequency derived from the drive clock signal, thus increasing the radiation noises.

OBJECT AND SUMMARY OF THE INVENTION

The present invention has been developed to solve the aforementioned problem. An object of the present invention is to provide a driving apparatus for driving a plasma display panel that can reduce radiation noises.

The driving apparatus for driving a plasma display panel according to the present invention drives a plasma display panel in which a plurality of row electrodes and column electrodes define discharge cells at their respective crossovers. Each of the plurality of row electrodes is arranged for each of scan lines, and the plurality of column electrodes are arranged in transverse relation with said row electrodes. The unit comprises panel drive means for applying a predetermined drive pulse repeatedly to each of said row and column electrodes in accordance with an input video signal. The unit also comprises application timing varying means for varying the application timing of said drive pulse as time goes by.

BRIEF DESCRIPTION OF THE DRAWINGS

These and other objects and advantages of the present invention will become clear from the following description with reference to the accompanying drawings, wherein.

DETAILED DESCRIPTION OF THE EMBODIMENTS

Before explanations of the embodiments are given, the configuration and operation of the drive portion of a prior-art plasma display device are first explained in detail with reference to FIGS. 2 and 3.

Figure 1:
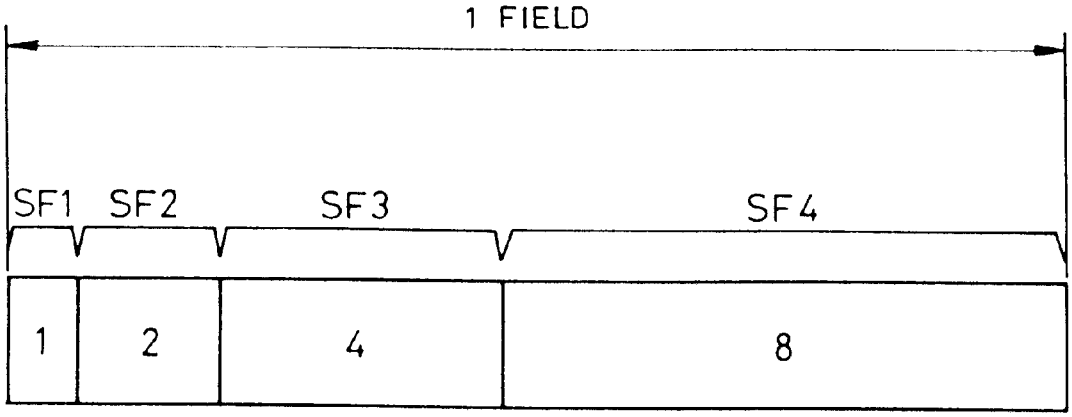
FIG. 1 RELATED ART
FIG. 1 is a view showing an example of a light emission drive format according to a sub-field method.
Figure 2:
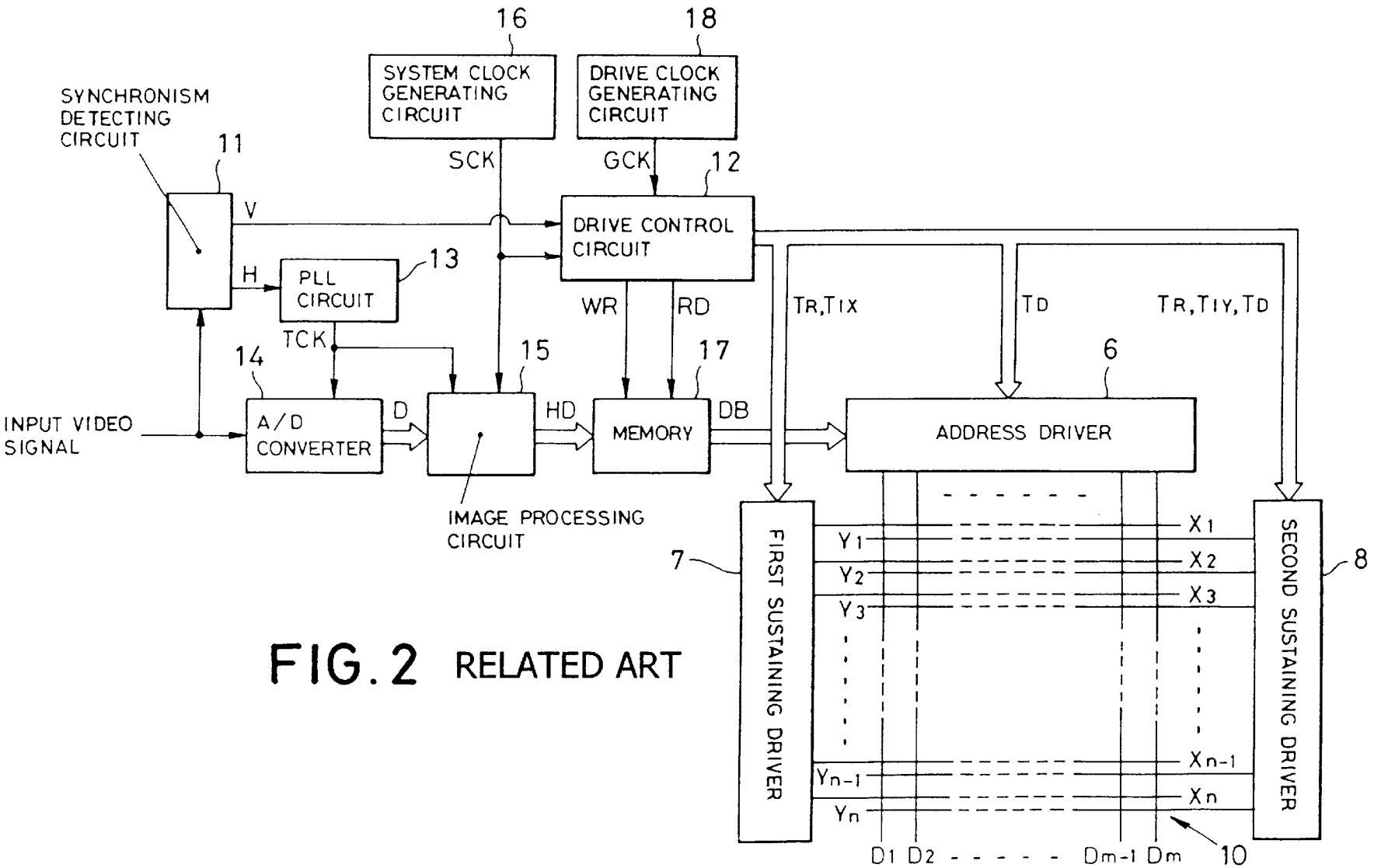
FIG. 2 RELATED ART
FIG. 2 is a schematic view showing the configuration of a plasma display device.

Referring to FIG. 2, a synchronism detecting circuit 11 in the drive portion generates a vertical synchronism detecting signal V when detecting a vertical synchronizing signal in analog input video signals and supplies the signal V to a drive control circuit 12. In addition, the synchronism detecting circuit 11 generates a horizontal synchronism detecting signal H when detecting a horizontal synchronizing signal in such input video signals and supplies the signal H to a PLL (Phase Locked Loop) circuit 13. The PLL circuit 13 generates, in phase with the horizontal synchronism detecting signal H, a sampling clock signal TCK that enables sampling the input video signals corresponding to each pixel of the PDP 10. Then, the PLL circuit 13 supplies the sampling clock signal TCK to each of an A/D converter 14 and an image processing circuit 15. The A/D converter 14 samples the input video signals, which have been inputted, in accordance with the aforementioned sampling clock signal TCK to convert the input video signal into N-bit pixel data D corresponding to each pixel. The image processing circuit 15 captures such pixel data D in accordance with the aforementioned sampling clock signal TCK. Then, the image processing circuit 15 performs, on the captured pixel data D, the image processing such as brightness correction, inverse gamma correction, and multi-gray-scale processing to obtain image processing pixel data HD, which is in turn supplied to a memory 17. Incidentally, such image processing is performed in accordance with a system clock signal SCK. A system clock generating circuit 16 generates a clock signal having a predetermined first fixed frequency as the aforementioned system clock signal SCK. Then, the system clock generating circuit 16 supplies the system clock signal SCK to each of the image processing circuit 15 and the drive control circuit 12. The memory 17 writes in sequence the aforementioned image processing pixel data HD in accordance with a write signal WR that is supplied from the drive control circuit 12. When a screenful of data (for n rows and m columns) has been written by such a write operation, the memory 17 divides the screenful of image processing pixel data $HD_{11-nm}$ into each of bit digits. Furthermore, the memory 17 groups the bit digits under each of the lines to capture the groups as a pixel drive data bit group $DB_1$–$DB_n$,. Then, the memory 17 reads the pixel drive data bit group $DB_1$–$DB_n$ sequentially in accordance with a read signal RD that is supplied from the drive control circuit 12 and then supplies the pixel drive data bit group $DB_1$–$DB_n$ to an address driver 6.

A drive clock generating circuit 18 generates a clock signal having a predetermined second fixed frequency as a drive clock signal GCK which is in turn supplied to the drive control circuit 12. The drive control circuit 12 generates the write signal WR and read signal RD, both of which are in phase with the aforementioned system clock signal SCK, and then supplies the signals to the memory 17 as described above.

Furthermore, the drive control circuit 12 generates a reset timing signal $T_R$ in synchronism with the aforementioned drive clock signal GCK. Then, the drive control circuit 12 supplies the reset timing signal $T_R$ to each of a first sustaining driver 7 and a second sustaining driver 8. In addition, the drive control circuit 12 generates a data timing signal $T_D$ in synchronism with the aforementioned drive clock signal GCK. Then, the drive control circuit 12 supplies the data timing signal $T_D$ to each of the address driver 6 and the second sustaining driver 8. Moreover, the drive control circuit 12 generates each of sustaining light-emission timing signals $T_{IX}$ and $T_{IY}$ in synchronism with the aforementioned drive clock signal GCK. Then, the drive control circuit 12 supplies the sustaining light-emission timing signals $T_{IX}$ and $T_{IY}$ to the first sustaining driver 7 and the second sustaining driver 8, respectively.

Figure 3:
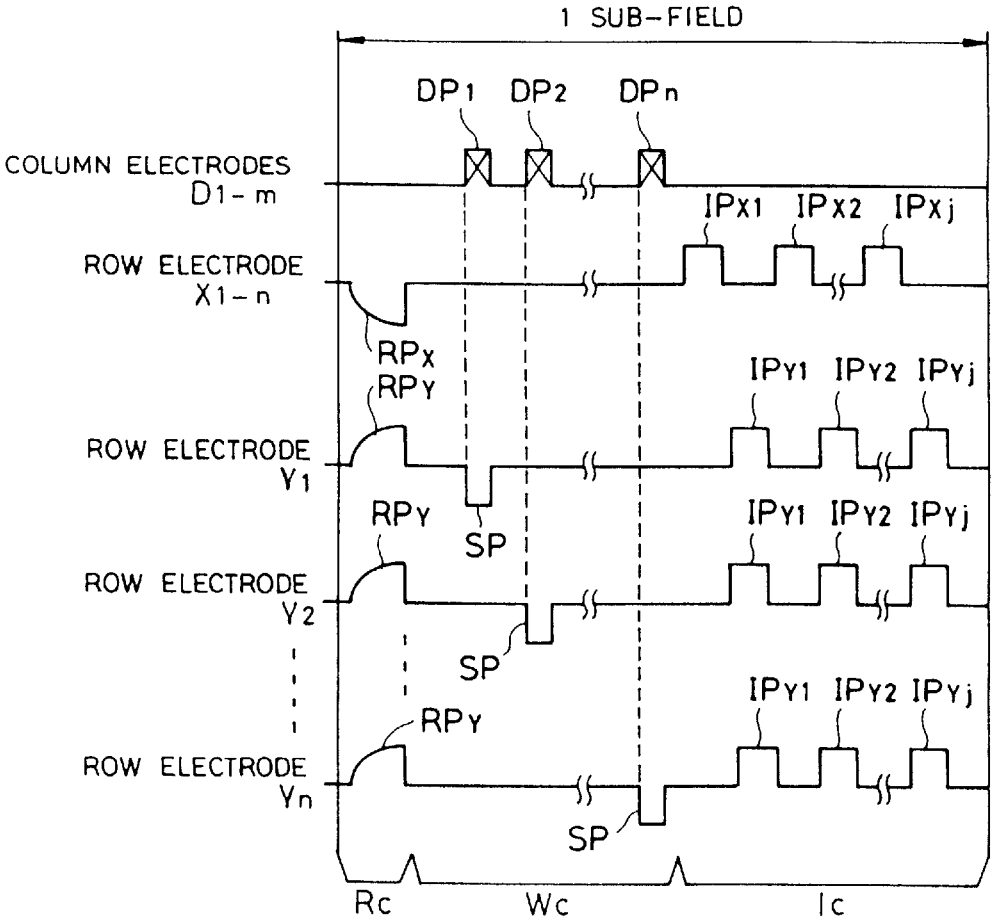
FIG. 3 RELATED ART
FIG. 3 is a view showing the application timing of a variety of drive pulses to be applied to a PDP 10 in one sub-field.

The first sustaining driver 7 generates a reset pulse $RP_X$ in each sub-field with the timing in accordance with the aforementioned reset timing signal $T_R$, for example, as shown in FIG. 3 and then applies the reset pulse $RP_X$ to the row electrodes $X_{1-n}$ of the PDP 10. In addition, the first sustaining driver 7 generates each of sustaining pulses $IP_{X1}$–$IP_{Xj}$ sequentially in each sub-field with the timing in accordance with the aforementioned sustaining light-emission timing signal $T_{IX}$ as shown in FIG. 3. Then, the first sustaining driver 7 applies the sustaining pulses $IP_{X1}$–$IP_{Xj}$ to the row electrodes $X_{1-n}$ of the PDP 10.

The address driver 6 generates a pixel data pulse group $DP_1$–$DP_n$ in each sub-field with the timing in accordance with the aforementioned data timing signal $T_D$ as shown in FIG. 3 and then applies the pixel data pulse group $DP_1$–$DP_n$ sequentially to the column electrodes $D_{1-m}$. Here, the pixel data pulse group $DP_1$–$DP_n$ corresponds to the pixel drive data bit group $DB_1$–$DB_n$ that is read from the aforementioned memory 17. Incidentally, it is to be understood that the address driver 6 generates a high-voltage pixel data pulse if a data bit in the pixel drive data bit group DB has, for example, a logic level of "0" which is applied to the column electrodes $D_{1-m}$ On the other hand, it is also to be understood that the address driver 6 generates a low-voltage (0 volt) pixel data pulse if the data bit has, for example, a logic level of "1" which is applied to the column electrodes $D_{1-m}$.

The second sustaining driver 8 generates a reset pulse RPY in each sub-field with the timing in accordance with the aforementioned reset timing signal $T_R$ as shown in FIG. 3 and then applies the reset pulse $RP_X$ to the row electrodes $Y_{1-n}$ of the PDP 10. In addition, the second sustaining driver 8 generates a scan pulse SP in each sub-field. Then, the second sustaining driver 8 applies the scan pulse SP to the row electrodes $Y_{1-Yn}$ sequentially with the timing in accordance with the aforementioned data timing signal $T_D$ as shown in FIG. 3. That is, the application timing of each scan pulse SP is in synchronism with that of each pulse of the aforementioned pixel data pulse group $DP_1$–$DP_n$. Moreover, the second sustaining driver 8 generates each of sustaining pulses $IP_{Y1}$–$IP_{Yj}$ sequentially in each sub-field with the timing in accordance with the aforementioned sustaining light-emission timing signal $T_{IY}$ as shown in FIG. 3. Then, the second sustaining driver 8 applies the sustaining pulses $IP_{Y1}$–$IP_{Yj}$ to the row electrodes $Y_{1-n}$ of the PDP 10.

Referring to FIG. 3, first, all discharge cells in the PDP 10 are allowed to carry out reset discharge in a reset step Rc in accordance with the simultaneous application of the aforementioned reset pulses $RP_X$ and $RP_Y$. After the reset discharge has been completed, a predetermined amount of wall electronic charges is formed in each of the discharge cells. This causes all discharge cells to be reset to a "light-emitting cell" state. Then, in a pixel data write step Wc in FIG. 3, a selective erase discharge is generated only in discharge cells located at crossovers of the "rows" to which the scan pulse SP is applied and the "columns" to which a high-voltage pixel data pulse DP is applied. Then, the wall electronic charges remaining in the discharge cells will disappear. That is, these discharge cells are changed into a "non-light-emitting cell" state. On the other hand, the aforementioned selective erase discharge is not generated in the discharge cells to which the scan pulse SP has been applied but a low-voltage pixel data pulse DP has been applied. In these discharge cells, the wall electronic charges remain which have been formed in the aforementioned reset step Rc, and thus the "light-emitting cell" state is sustained. Then, in a light-emission sustaining step Ic in FIG. 3, only such discharge cells as in the aforementioned "light-emitting cell" state are allowed to discharge to emit light each time the sustaining pulses $IP_{Y1}$–$IP_{Yj}$ and $IP_{X1}$–$IP_{Xj}$ are alternately applied. Incidentally, the number of times of application (2j) of the sustaining pulses $IP_{X1}$–$IP_{Yj}$ and $IP_{X1}$–$IP_{Xj}$ is predetermined in accordance with the weight assigned to this sub-field.

As such, various drive pulses are applied to the PDP 10 in each sub-field with the timing as shown in FIG. 3 in accordance with the drive clock signal GCK, thereby implementing the display of gray scale brightness in accordance with an input video signal.

However, radiation noises are generated by the aforementioned reset pulses $RP_X$ and $RP_Y$ the scan pulse SP, the pixel data pulse group DP, and the pulse trains of the sustaining pulses $IP_{Y1}$–$IP_{Yj}$ and $IP_{X1}$–$IP_{Xj}$. As mentioned in the foregoing, the configuration shown in FIG. 2 causes the spectrum of the radiation noises to concentrate on the natural frequency derived from the drive clock signal GCK and thus the radiation noises are increased.

The embodiments of the present invention will be explained below with reference to the drawings.

Figure 4:
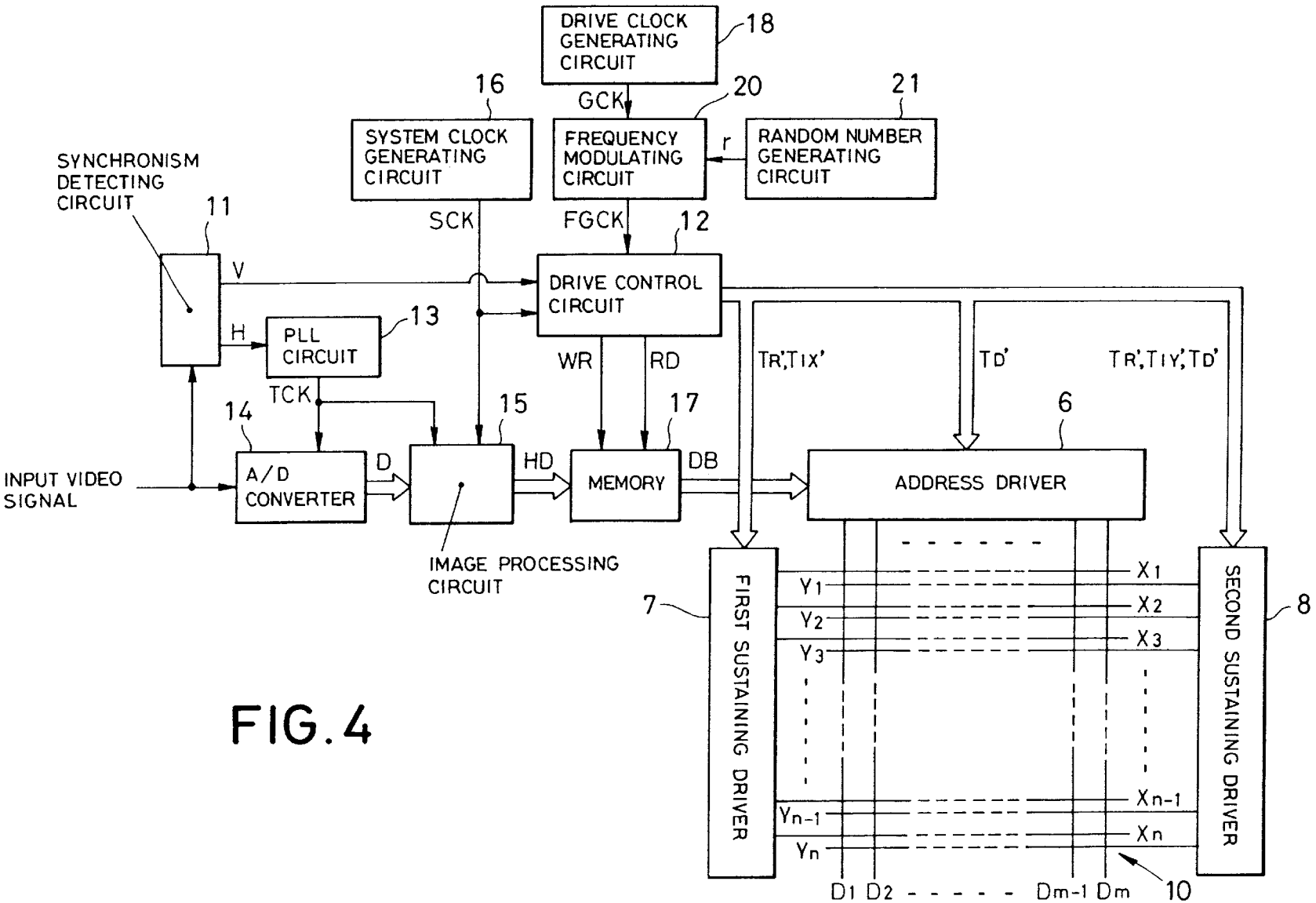
FIG. 4 is a schematic view showing the configuration of a plasma display device that employs a driving apparatus according to the present invention.

FIG. 4 is a schematic view showing the configuration of a plasma display device incorporating a driving apparatus according to the present invention.

As shown in FIG. 4, such plasma display device comprises a plasma display panel or the PDP 10 and a drive portion for driving the PDP 10 in accordance with an input video signal.

The PDP 10 comprises address electrodes or m column electrodes $D_1$–$D_m$, and n row electrodes $X_1$–$X_n$ and n row electrodes $Y_1$–$Y_n$, the row electrodes being arranged in transverse relation with each of the column electrodes. Here, a pair of a row electrode X and a row electrode Y forms a row electrode that corresponds to one row of the PDP 10. The column electrodes D and the row electrodes X and Y are dielectrically insulated in discharge spaces, and a discharge cell is formed corresponding to one pixel at a crossover of each of the pairs of row electrodes and a column electrode.

On the other hand, the synchronism detecting circuit 11 in the drive portion generates the vertical synchronism detecting signal V when detecting a vertical synchronizing signal in analog input video signals and supplies the signal V to the drive control circuit 12. In addition, the synchronism detecting circuit 11 generates the horizontal synchronism detecting signal H when detecting a horizontal synchronizing signal in such input video signals and supplies the signal H to the PLL (Phase Locked Loop) circuit 13. The PLL circuit 13 generates, in phase with the horizontal synchronism detecting signal H, the sampling clock signal TCK that enables sampling the input video signals corresponding to each pixel of the PDP 10. Then, the PLL circuit 13 supplies the sampling clock signal TCK to each of the A/D converter 14 and an image processing circuit 15.

The A/D converter 14 samples the input video signals, which have been inputted, in accordance with the aforementioned sampling clock signal TCK to convert the input video signal into N-bit pixel data D corresponding to each pixel. The image processing circuit 15 captures such pixel data D in accordance with the aforementioned sampling clock signal TCK. Then, the image processing circuit 15 performs, on the captured pixel data D, the image processing such as brightness correction, inverse gamma correction, and multi-gray-scale processing to obtain image processing pixel data HD, which is in turn supplied to the memory 17. Incidentally, such image processing is performed in accordance with the system clock signal SCK.

The system clock generating circuit 16 generates a clock signal having a predetermined first fixed frequency as the aforementioned system clock signal SCK. Then, the system clock generating circuit 16 supplies the system clock signal SCK to each of the image processing circuit 15 and the drive control circuit 12.

The memory 17 writes in sequence the aforementioned image processing pixel data HD in accordance with the write signal WR that is supplied from the drive control circuit 12. When a screenful of data (for n rows and m columns) has been written by such a write operation, the memory 17 divides the screenful of image processing pixel data $HD_{11-nm}$ into each of bit digits. Furthermore, the memory 17 groups the bit digits under each of the lines to capture the groups as the pixel drive data bit group $DB_1$–$DB_n$. Then, the memory 17 reads the pixel drive data bit group $DB_1$–$DB_n$ sequentially in accordance with the read signal RD that is supplied from the drive control circuit 12 and then supplies the pixel drive data bit group $DB_1$–$DB_n$ to the address driver 6.

The drive clock generating circuit 18 generates a clock signal having a predetermined second fixed frequency as a drive clock signal GCK which is in turn supplied to a frequency modulating circuit 20. A random number generating circuit 21 generates a random number r that is updated every predetermined period and then supplies the random number r to the frequency modulating circuit 20.

Figure 5:
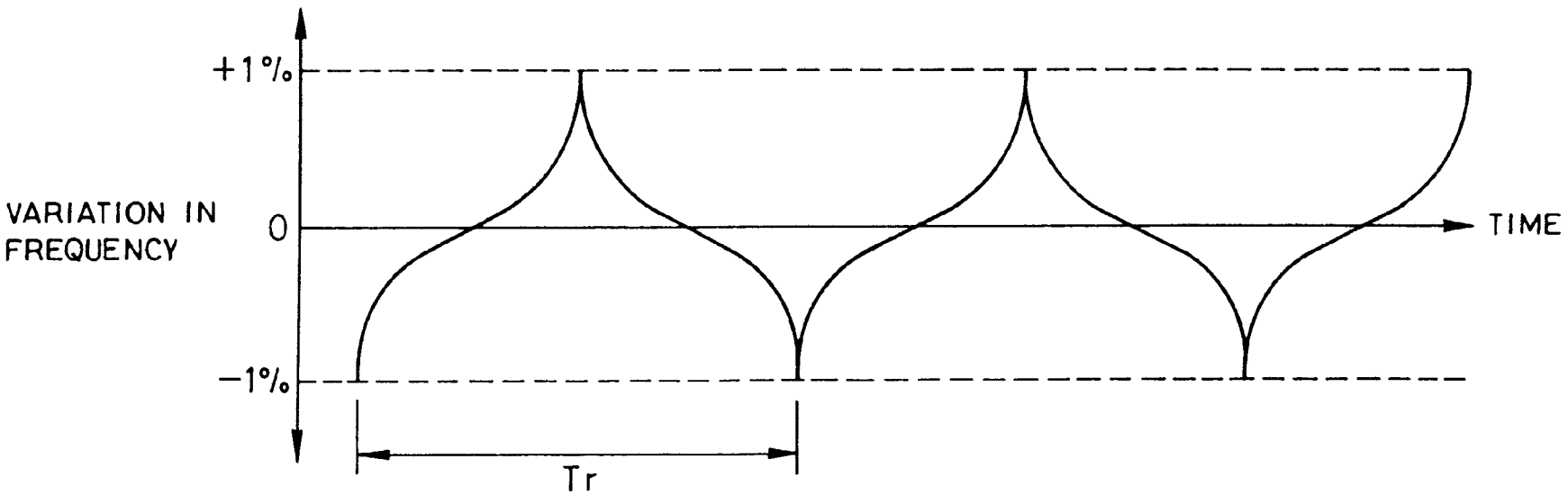
FIG. 5 is a view showing an example of a frequency modulation format applied to a drive clock signal GCK by a frequency modulating circuit 20.

The frequency modulating circuit 20 modulates the frequency of the aforementioned drive clock signal GCK with a modulation period in accordance with the random number r, thereby generating a frequency modulating drive clock signal FGCK. The frequency of the frequency modulating drive clock signal FGCK is varied in succession as time goes by. The frequency modulating circuit 20 supplies the frequency modulating drive clock signal FGCK to the drive control circuit 12. For example, the frequency modulating circuit 20 modulates the frequency of the aforementioned drive clock signal GCK in such a manner as shown in FIG. 5. That is, the frequency modulating circuit 20 modulates the frequency with a modulation period $T_r$ in accordance with the aforementioned random number r in such a manner as to generate a variation in frequency of +/− 1% to generate the frequency modulating drive clock signal FGCK.

The drive control circuit 12 generates each of the write signal WR and read signal RD, both of which are in phase with the aforementioned system clock signal SCK, and then supplies the signals to the memory 17 as described above.

Furthermore, the drive control circuit 12 generates a reset timing signal $T_R'$ in accordance with the aforementioned frequency modulating drive clock signal FGCK. Then, the drive control circuit 12 supplies the reset timing signal $T_R'$ to each of the first sustaining driver 7 and the second sustaining driver 8. In addition, the drive control circuit 12 generates a data timing signal $T_D'$ in accordance with the aforementioned frequency modulating drive clock signal FGCK. Then, the drive control circuit 12 supplies the data timing signal $T_D'$ to each of the address driver 6 and the second sustaining driver 8. Moreover, the drive control circuit 12 generates each of sustaining light-emission timing signals $T_{IX}'$ and $T_{IY}'$ in accordance with the aforementioned frequency modulating drive clock signal FGCK. Then, the drive control circuit 12 supplies the sustaining light-emission timing signals $T_{IX}'$ and $T_{IY}'$ to the first sustaining driver 7 and the second sustaining driver 8, respectively.

Figure 6:
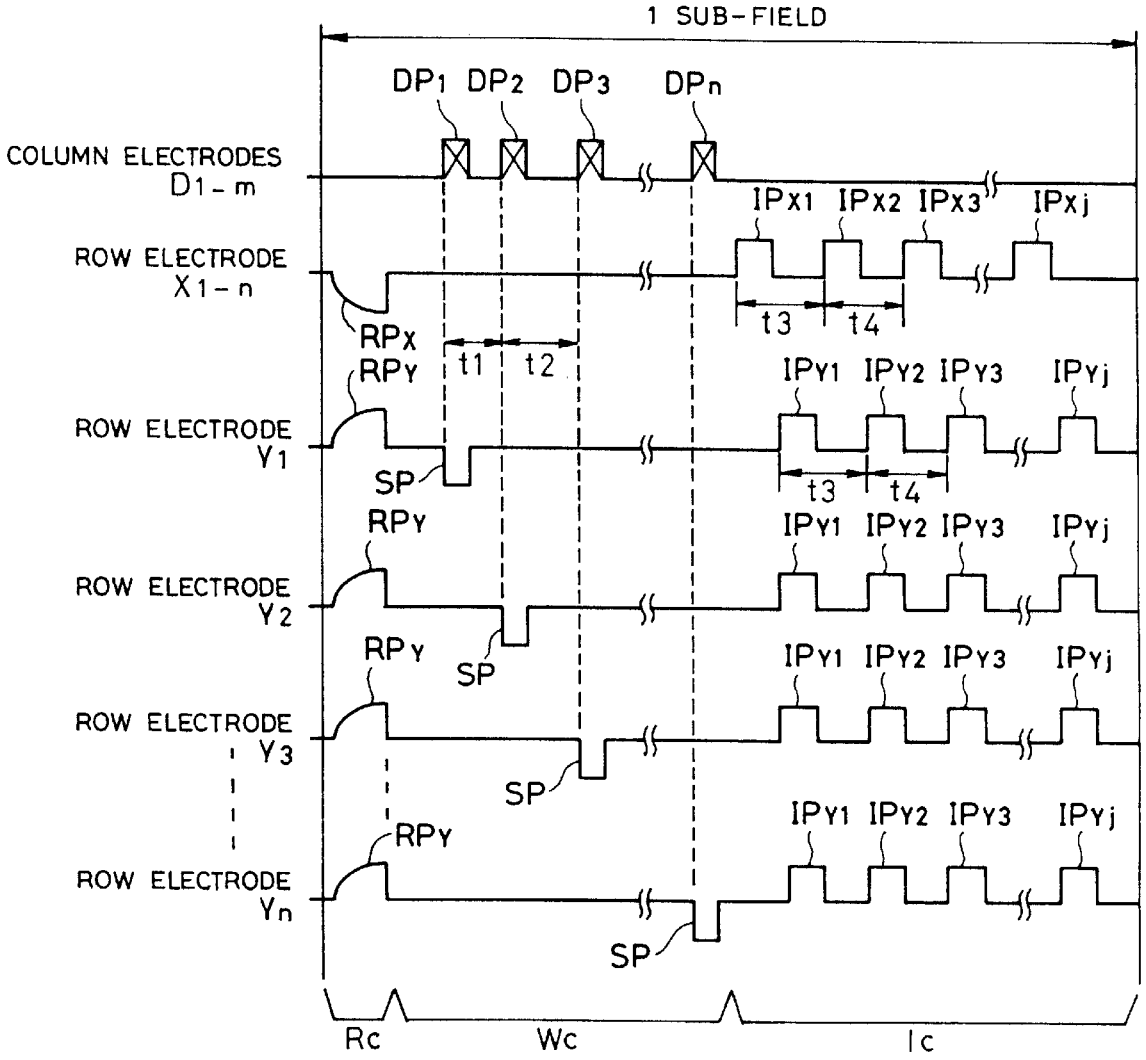
FIG. 6 is a view showing the application timing of a variety of drive pulses to be applied to a PDP 10 by means of a driving apparatus according to the present invention.

The first sustaining driver 7 generates a reset pulse $RP_X$ in each sub-field with the timing in accordance with the aforementioned reset timing signal $T_R'$, for example, as shown in FIG. 6 and then applies the reset pulse $RP_X$ to the row electrodes $X_{1-n}$ of the PDP 10. In addition, the first sustaining driver 7 generates each of sustaining pulses $IP_{X1}$–$IP_{Xj}$ sequentially in each sub-field with the timing in accordance with the aforementioned sustaining light-emission timing signal $T_{IX}'$ as shown in FIG. 6. Then, the first sustaining driver 7 applies the sustaining pulses $IP_{X1}$–$IP_{Xj}$ to the row electrodes $X_{1-n}$ of the PDP 10.

The address driver 6 generates the pixel data pulse group $DP_1$–$DP_n$ in each sub-field with the timing in accordance with the aforementioned data timing signal $T_D'$ as shown in FIG. 6 and then applies the pixel data pulse group $DP_1$–$DP_n$ sequentially to the column electrodes $D_{1-m}$. Here, the pixel data pulse group $DP_1$–$DP_n$ corresponds to the pixel drive data bit group $DB_1$–$DB_n$ that is read from the aforementioned memory 17. Incidentally, it is to be understood that the address driver 6 generates a high-voltage pixel data pulse if a data bit in the pixel drive data bit group DB has, for example, a logic level of "0" which is applied to the column electrodes $D_{1-m}$. On the other hand, it is also to be understood that the address driver 6 generates a low-voltage (0 volt) pixel data pulse if the data bit has, for example, a logic level of "1" which is applied to the column electrodes $D_{1-m}$.

The second sustaining driver 8 generates a reset pulse $RP_Y$ in each sub-field with the timing in accordance with the aforementioned reset timing signal $T_R'$ as shown in FIG. 6 and then applies the reset pulse $RP_X$ to the row electrodes $Y_{1-n}$ of the PDP 10. In addition, the second sustaining driver 8 generates a scan pulse SP in each sub-field. Then, the second sustaining driver 8 applies the scan pulse SP to the row electrodes $Y_1$–$Y_n$ sequentially with the timing in accordance with the aforementioned data timing signal $T_D$ ' as shown in FIG. 6. That is, the application timing of each scan pulse SP is in synchronism with that of each pulse of the aforementioned pixel data pulse group $DP_1$–$DP_n$. Moreover, the second sustaining driver 8 generates each of sustaining pulses $IP_{Y1}$–$IP_{Yj}$ sequentially in each sub-field with the timing in accordance with the aforementioned sustaining light-emission timing signal $T_{IY}'$ as shown in FIG. 6. Then, the second sustaining driver 8 applies the sustaining pulses $IP_{Y1}$–$IP_{Yj}$ to the row electrodes $Y_{1-n}$ of the PDP 10.

Here, the aforementioned data timing signal $T_D'$ is generated by the frequency modulating circuit 20 in accordance with the frequency modulating drive clock signal FGCK that is frequency modulated in such a manner as shown in FIG. 5. Accordingly, this causes the application period of each of the pixel data pulse group $DP_1$–$DP_n$ and the scan pulse SP to be varied every moment in accordance with a variation in the period of the frequency modulating drive clock signal FGCK. For example, as shown in FIG. 6, the application period t1 and t2 are different from each other. Here, the application period t1 is the time from the application of the pixel data pulse group $DP_1$ to that of the pixel data pulse group $DP_2$. Moreover, the application period t2 is the time from the application of the pixel data pulse group $DP_2$ to that of the pixel data pulse group $DP_3$.

Furthermore, the aforementioned sustaining light-emission timing signals $T_{IX}'$ and $T_{IY}'$ are also generated in accordance with the frequency modulating drive clock signal FGCK that is frequency modulated in such a manner as shown in FIG. 5. Accordingly, this also causes the application period of each of the sustaining pulses $IP_{Y1}$–$IP_{Yj}$ ($IP_{X1}$–$IP_{Xj}$) to be varied every moment in accordance with a variation in the period of the frequency modulating drive clock signal FGCK. For example, as shown in FIG. 6, the application period t3 and t4 are different from each other. Here, the application period t3 is the time from the application of the sustaining pulse $IP_{Y1}$ ($IP_{X1}$) to that of the sustaining pulse $IP_{Y2}$ ($IP_{X2}$). Moreover, the application period t4 is the time from the application of the sustaining pulse $IP_{Y2}$ ($IP_{X2}$) to that of the subsequent sustaining pulse $IP_{Y3}$ ($IP_{X3}$).

Furthermore, the period $T_r$ of a variation in frequency of the frequency modulating drive clock signal FGCK as shown in FIG. 5 is adapted to vary every moment in accordance with the random number r generated by the random number generating circuit 21.

Accordingly, this eliminates the concentration of the spectrum of the radiation noises on the natural frequency, the noises generated by pulse trains of drive pulses such as the pixel data pulse DP and the sustaining pulse IP, repeatedly applied to the PDP 10, thereby preventing the radiation noises from increasing.

As described above, the present invention varies the application timing of each of the drive pulses as time goes by, which are applied repeatedly to the row electrodes and the column electrodes of a plasma display panel. The spectra of radiation noises generated by trains of drive pulses are thereby prevented from concentrating on the natural frequency.

Therefore, according to the present invention, radiation noises generated by trains of such drive pulses are prevented from increasing.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A driving apparatus for driving plasma display panel in which a plurality of row electrodes and column electrodes define discharge cells at their respective crossovers, each of the plurality of row electrodes being arranged for each of scan lines, the plurality of column electrodes being arranged in transverse relation with said row electrodes, said driving apparatus comprising:

panel drive means for applying a predetermined drive pulse repeatedly to each of said row and column electrodes in accordance with an input video signal, and application timing varying means for varying an application timing of said drive pulse as time elapses.

2. The driving apparatus for driving plasma display panel according to claim 1, wherein said application timing varying means comprise a drive clock generating circuit for generating a drive clock signal having a predetermined fixed frequency and a frequency modulating circuit for modulating the frequency of said drive clock signal to generate a frequency modulated drive clock signal, and said panel drive means apply said drive pulse repeatedly to each of said row electrodes and said column electrodes at an application timing in accordance with said frequency modulated drive clock signal.

3. The driving apparatus for driving plasma display panel according to claim 2, comprising a random number generating circuit for generating random numbers, wherein said frequency modulating circuit varies the frequency of said drive clock signal in accordance with modulation periods corresponding to said random numbers to obtain said frequency modulated drive clock signal.

* * * * *